United States Patent [19]

Terskov et al.

[11] Patent Number: 4,819,741

[45] **Date of Patent: * Apr. 11, 1989**

[54] REVERSIELE PERCUSSION DEVICE

[76] Inventors: Alexei D. Terskov, ulitsa Ippodromskaya, 31, kv. 154; Vladimir D. Plavskikh, ulitsa Ivanova, 30, kv. 7; Alexandr D. Kostylev, ulitsa Derzhavina, 18, kv. 44; Nikolai G. Nazarov, ulitsa Gogolya, 3, kv. 10; Nikolai P. Chepurnoi, ulitsa 1905 Oktyabrya, 28, kv. 92; Evgeny N. Cherednikov, Vokzalnaya magistral, 5, kv. 329; Andron T. Karavaev, Pervomaiskaya ulitsa, 118, kv. 19, all of Novosibirsk, U.S.S.R.

[ * ] Notice: The portion of the term of this patent subsequent to Nov. 11, 2000 has been disclaimed.

[21] Appl. No.: 243,915

[22] PCT Filed: Jul. 2, 1979

[86] PCT No.: PCT/SU79/00045

§ 371 Date: Feb. 25, 1981

§ 102(e) Date: Feb. 25, 1981

[87] PCT Pub. No.: WO81/00124

PCT Pub. Date: Jan. 22, 1981

[51] Int. Cl.[4] ..... B25D 9/16

[52] U.S. Cl. ..... 173/91; 175/19

[58] Field of Search ..... 173/91; 175/19

[56] References Cited

U.S. PATENT DOCUMENTS 4,078,619 3/1978 Sudnishnikov et al. ..... 173/91

*Primary Examiner*—Frank T. Yost

*Assistant Examiner*—James L. Wolfe

*Attorney, Agent, or Firm*—Burgess, Ryan and Wayne

[57] ABSTRACT

A reversible percussion device, having a casing 1 in which is installed a movable striker and a system for distributing fluid under pressure for causing the striker 4 to move for both forward and rearward movement functions of the device. The system comprises a control member 9 for controlling the distribution of fluid under pressure for both functions, which is movably coupled to the striker 4 and has a mechanism for locking it with respect to the casing 1 in two control positions, corresponding to the two functions of the device. According to the invention, the mechanism for locking the control member 9 in the position enabling the forward movement functions of the device comprises a body 11 movable relative to the control member 9. The body 11 is installed in such a manner as to have a portion adapted to be acted upon by fluid under pressure so as to engage the casing 1 in one position to axially lock the control member 9 with respect to the casing 1 and in the other position to enable the mobility of the control member 9 relative to the casing 1 when the device is switched over for the rearward movement function.

4 Claims, 3 Drawing Sheets

REVERSIELE PERCUSSION DEVICE

FIELD OF THE ART

The invention relates to the construction equipment, and more particularly to percussion devices.

The device according to the invention may find application, e.g. in making holes in soil for a trench-less laying of under-ground engineering lines.

The invention may further be used in impact equipment for driving casings into soil, making cast-in-place piles and soil sampling in conducting engineering geological investigations.

BACKGROUND OF THE INVENTION

Known in the art are percussion devices (cf. British patent specification No. 1170167, publ. Mar. 14, 1967), comprising a casing, a striker accommodated in the casing for reciprocations under the action of fluid under pressure and a fluid distribution system enabling the reciprocations of the striker and causing the striker to impart blows to the casing either toward the front- end part of the casing (forward movement function) or toward the rear-end part of the casing (rearward movement function).

The distribution of fluid under pressure for both functions of the device is controlled by a control member which is movably coupled to the striker. The control member may be installed in two positions with respect to the casing - in the front- end or in the rear-end position, the control member controlling the distribution of fluid under pressure to enable the forward movement function when in one position and controlling the distribution of fluid under pressure to enable the rearward movement function when in the other position.

The control member is coupled to the casing by means of a tube communicating with a source of fluid under pressure, having a helical groove cooperating with a helical groove of a flange attached to the casing. Fluid under pressure is fed to the tube by means of a flexible conduit connected to the tube.

Two pairs of stops are provided on the tube and flange to limit the displacement of the control member when the tube rotates in the flange. The tube is caused to rotate in the flange by imparting rotary motion to the flexible conduit.

The flexible tube should be rotated to bring the control member to the position enabling the forward movement function of the device. The tube is thus caused to move together with the control member to the front-end position until the engagement of the front-end stops of the tube and flange. Upon the admission of fluid under pressure the striker starts reciprocating in the casing and imparting blows thereto which are directed toward the front-end (head) part of the casing, and the entire device moves through the soil leaving a hole therebehind.

To switch the device over for rearward movement function (reversal), fluid under pressure should be shut-off. Then the flexible conduit should be rotated in the opposite direction. The control member is thus caused to move together with the tube toward the rear-end position owing to the provision of helical grooves on the tube and flange until the rear-end stops of the tube and flange engage one another; in this position the control member enables reciprocations of the striker in the casing so as to impart blows thereto in the direction toward the rear-end (tail) part of the casing, and the entire device is caused to move under the action of such blows in the opposite direction through the hole, that is the device works in the rearward movement function.

For switching the device over back for the forward movement function, the control member should be moved back to the front-end position as described above.

The above-described devices are characterized by difficulties encountered in reversing, because with considerable length of a hole and flexible conduit and with an unstable hole (when driving holes in loose soils) the transmission of rotary motion to the tube through the flexible conduit is extremely difficult. The helical grooves of the tube and flange may also be clogged to result in jamming and this also hampers the reversal.

Still another feature of known devices is associated with failure to maintain the pre-set function, that is with the possibility of self-reversal. This is due to the absence of a reliable latching of the control member relative to the casing in each working position since the stops of the tube and flange can lock the tube and hence the control member in one direction only so that upon turning motions of the flexible conduit during operation of the debice (which may be the case if the flexible conduit has hot been straightened beforehands) the tube and the control member associated therewith may take the other position, and the device will be reversed, that is the function will be changed.

The prior art devices are not convenient in operation in that one must make it certain which of the two functions is pre-set in the device before each starting (e.g., by making a test starting). Thus, after the device leaves the hole it should be switched over from the rearward movement function to the forward movement function so as to prepare for a new starting. In addition, the control member may take an intermediate position between the forward and the rearward movement positions (e.g., during transportation).

Known in the art are reversible percussion devices (cf. German patent No. 2340751, publ. Aug. 11, 1973), comprising a casing, a striker installed in the casing for reciprocations under the action of fluid under pressure and a fluid distribution system enabling the reciprocations of the striker so as to impart blows to the casing which are directed either toward the front-end (head) part of the casing for the forward movement function of the device or toward the rear-end (tail) part of the casing for the rearward movement function of the device.

The distribution of fluid under pressure for both functions of the device is controlled by means of a control member which is movably coupled to the striker.

The control member may be locked in two positions with respect to the casing: in the front-end and in the rear-end positions, the control member controlling the distribution of fluid under pressure to enable the forward movement function when in one (front-end) position and controlling the distribution of fluid under pressure to enable the rearward movement function when in the other (rear-end) position.

The control member is coupled to the casing by means of a tube connected to a flange. The flange is rigidly secured to the casing. Fluid under pressure is fed to the tube by means of a flexible conduit connected thereto. The control member is locked in one of two positions with respect to the casing by means of two pairs of stops provided on the tube and alternatively engaging the flange and by means of a spring-biased ball locking member which is installed in the flange and coupled to a control rope. The flange also has longitudinal grooves for receiving the tube stops.

To install the control member in the front-end position so as to enable operation of the device with the forward movement function, the control rope should be pulled so as to release the locking ball from a seat of the tube.

To switch the device over for the rearward movement (reversed) function, the supply of fluid under pressure should be interrupted. The locking ball should be released from its seat by pulling the control rope. The tube is then caused to rotate at a certain angle by turning the flexible conduit so that the tube stops be positioned opposite to the flange grooves. Subsequently the flexible conduit is pulled without removing the pulling force from the control rope, thereby to move the tube axially in such a manner that the front-end pair of stops of the tube should now be on the opposite side of the flange, and the tube is then turned at a certain angle again so that the locking ball should be opposite to its seat in the tube. When the pulling force is removed from the control rope, the ball locks the tube between the front-end pair of stops (and also locks the control member) with respect to the flange and casing. Upon feeding fluid under pressure to the device the striker reciprocates in the casing to impart blows thereto in the direction toward its rear-end (tail) part, and the entire device will move backward through the driven hole, that is the rearward movement function is obtained.

To switch the device over back for the forward movement function, the control member should be moved back to the front-end position as described above.

The above-described devices are characterized in that, in addition to a complicate structure, the reversal is not convenient and reliable since several operations should be made simultaneously with the control rope (pulling) and flexible conduit (turning and pulling). This is not easy and convenient for one operator to do. In addition, it is very difficult if possible to turn the flexible conduit in driving long holes in loose or unstable soils.

The above-described devices also do not have a mechanism for automatically bringing the control member to a position corresponding to the forward movement function. Thus manipulations for switching the device over for the forward movement function should be made before each starting of the device.

In addition, all such devices do not make it possible to change from the rearward movement function to the forward movement function (e.g., under emergency conditions). In order to make such change, the tube shoulds be caused to move axially forward. This cannot be done when dealing with a flexible conduit.

SUMMARY OF THE INVENTION

It is an object of the invention to eliminate the above-mentioned disadvantages of prior art reversible percussion devices.

Another object of the invention is to facilitate the change in the working function (reversal) of the device.

Still another object of the invention is to improve the reliability of change in the working function (reversal) of the device.

The invention is based on the problem of providing a reversible percussion device which is reliable and simple in operation and is easy to manufacture by using new means for locking the control member in its limit positions with respect to the casing.

The invention resides in that in a reversible percussion device, comprising a casing in which is installed a striker for reciprocations under the action of fluid under pressure and a fluid distribution system which enables the reciprocations of the striker so as to impart blows to the front-end part of the casing when the device is set for the forward movement function and to impart blows to the rear-end part of the casing for the rear-ward movement function of the device and which has a control member for controlling the distribution of fluid under pressure in both forward and rearward movement functions which is movably coupled to the striker and has locking means for locking the control member with respect to the casing in two control positions, the control member controlling the distribution of fluid under pressure for the forward movement function when in one position and controlling the distribution of fluid under pressure for the rearward movement function when in the other position, according to the invention, the locking means for locking the control member in at least one position enabling the forward movement function of the device comprises a body which is movable relative to the control member and which is installed with respect to the control member and casing in such a manner as to have a portion adapted to be acted upon by fluid under pressure so that the body engages the casing in one position under the action of fluid under pressure to axially fix the control member relative to the casing and enables the movement of the control member relative to the casing in the other position when the device is switched over for the rearward movement function.

The invention provides a reversible percussion device which enables a reliable locking of the control member in its limit positions with respect to the casing while being simple in manufacture and more convenient and reliable in operation compared to known devices of similar type.

The movable body is preferably installed in a socket of the control member communicating with a source of fluid under pressure.

This embodiment makes it possible to use the energy of fluid under pressure for causing the movable body to move to the position at which it axially locks the control member with respect to the casing.

The casing is preferably made with a seat for receiving the movable body and for locking the control member with respect to the casing when the movable body is received in the seat.

This embodiment improves the reliability of locking of the control member with respect to the casing.

The socket of the control member preferably communicates with the source of fluid under pressure through an opening of the control member.

This embodiment enables the supply of fluid under pressure to the socket of the control member by using simple means.

The movable body preferably comprises a U-shaped body and is preferably installed in the socket of the control member which is made in the form of a groove provided externally in the control member.

This embodiment makes it possible to increase the action of fluid under pressure on the movable body thereby improving the reliability of the device in operation.

The groove of the control member is preferably eccentrically arranged with respect to the longitudinal axis of the device and the movable body is made as a crescent-shaped body to conform with the shape of the groove.

This embodiment makes it possible to reduce the size of locking means of the control member and to simplify the design.

The movable body is preferably spring-biased with respect to the control member.

This embodiment improves the reliability of displacement of the movable member into the groove of the control member so as to improve the reliability of the device in operation.

The control member is preferably provided with a leaf spring having one end received in a recess of the control member and the other end bearing against the movable body.

This embodiment simplifies the design of the device.

The control member is preferably biased by a spring with respect to the casing.

This embodiment enables an automatic switching of the devices from the rearward movement function to the forward movement function.

BRIEF DESCRIPTION OF THE DRAWINGS

The invention will now be described with reference to a specific embodiment illustrated in the drawings, in which.

DESCRIPTION OF THE PREFERRED EMBODIMENT

Figure 1:
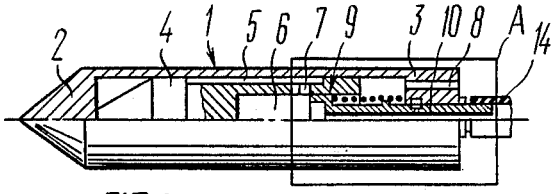
FIG. 1 is a general view, partially in longitudinal section, of a reversible percussion devices according to the invention.
Figure 3:
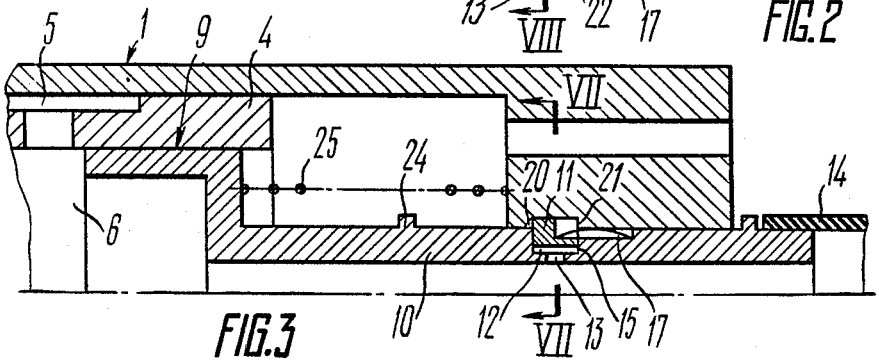
FIG. 3 is the detail A in FIG. 1 showing the position of parts for the forward movement function of the device.
Figure 4:
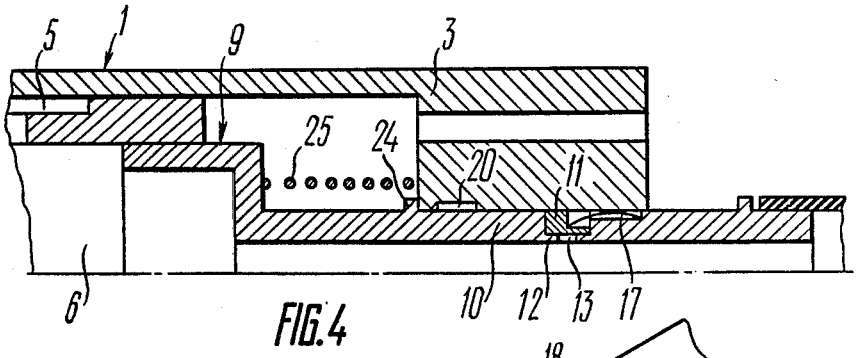
FIG. 4 is the detail A in FIG. 1 showing the position of parts for the rearward movement function of the device.
Figure 8:
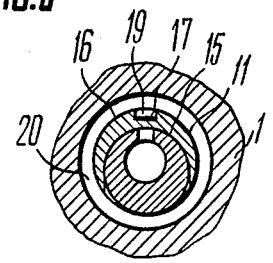
FIG. 8 is a sectional view taken along the line VIII—VIII in FIG. 2.
Figure 7:
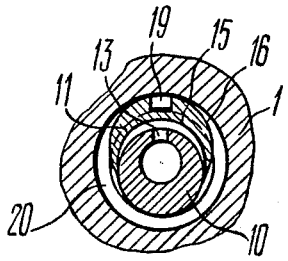
FIG. 7 is a sectional view taken along the line VII—VII in FIG. 3.

A device shown in FIG. 1 comprises a hollow casing 1 having a head (front-end) portion 2 and a tail (rear-end) portion 3 which are designed to receive blows of a striker 4. The striker 4 reciprocates in the casing 1 under the action of fluid under pressure. In the forward movement function the striker 4 imparts blows to the head part 2 of the casing 1. In the rearward movement function the striker 4 imparts blows to the tail part 3 of the casing 1. The device also comprises a fluid distribution system for distributing fluid under pressure for both forward and rearward movement functions of the device. This system includes a front-end working chamber 5 which is defined by the inner surface of the casing 1 and the outer surface of the striker 4, and a rear-end working chamber 6 which is defined by the inner space of the striker 4. The system also comprises ports 7 for interconnecting the front-end working chamber 5 and the rear-end working chamber 6 and ports 8 in the casing 1 for discharge of fluid under pressure into atmosphere. The device also comprises a control member 9 having one end which is movably coupled to the striker 4, the other end of the control member comprising a tube 10 connected to the casing 1. The control member 9 may take two positions with respect to the casing, the control member controlling the distribution of fluid under pressure from the forward movement function of the device when in one (front-end) position and controlling the distribution of fluid under pressure for the rearward movement function of the device when in the other (rear-end) position. The device also comprises means for locking the control member 9 in at least one position enabling the forward movement function of the device. The locking means comprises a movable body 11 (FIG. 2) which is movable relative to the control member 9. The movable body 11 engages the casing 1 in one position (as shown in FIGS. 3 and 7) so as to axially fix the control member 9 with respect to the casing 1. In the other position the movable body 11 enables the movement of the control member 9 with respect to the casing 1 when the device is switched over for the rearward movement function (as shown in FIGS. 4 and 8). The movable body 11 (FIGS. 3, 4) is installed in a socket 12 provided in the tube 10 of the control member 9. The socket 12 communicates with a source of fluid under pressure (not shown). The socket 12 preferably communicates with a source of fluid under pressure through an opening 13 of the tube 10 of the control member 9 and through a flexible conduit 14. One end of the conduit 14 is connected to the tube 10 of the control member 9 and the other end is connected to a source of fluid under pressure.

Figure 6:
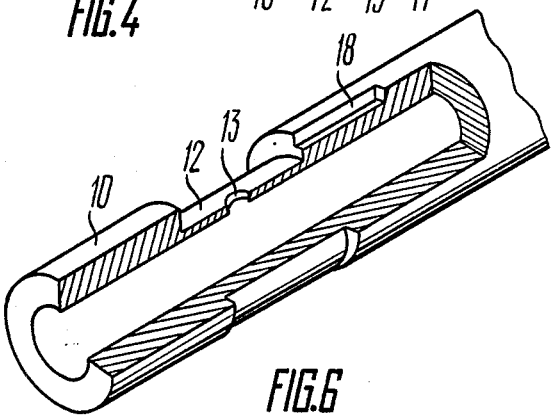
FIG. 6 is a perspective view, partially in section, of a part of a control member having a socket for receiving the movable body, according to the invention.
Figure 5:
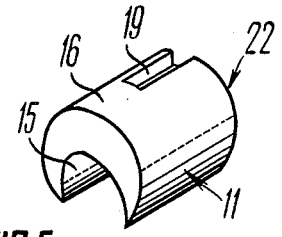
FIG. 5 is a perspective view of a movable body according to the invention.

To simplify the design, the movable body 11 (as shown in FIG. 5) is made as a U-shaped body, the inner surface 15 and the outer surface 16 of the U-shaped body being arranged eccentrically with respect to one another so that the U-shaped movable body 11 is made as a crescent-shaped body. In accordance with the shape of the surfaces of the movable body, the socket 12 (as shown in FIGS. 3 and 6) comprises a groove in the outer surface of the tube 10 of the control member 9. The axis of the groove is offset with respect to the axis of the device. This facility enables the conformity of the shapes of the surfaces of the movable crescent-shaped body 11 and of the socket 12 made in the form of the an eccentric groove. The opening 13 is made in the socket 12.

Figure 2:
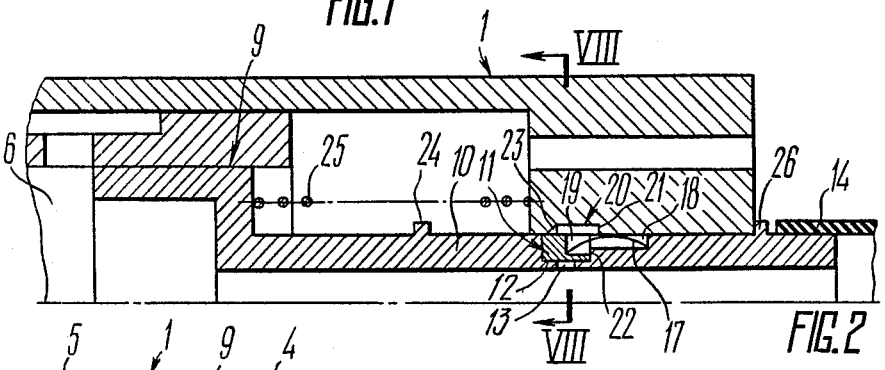
FIG. 2 is a detail A in FIG. 1 showing the position of parts before feeding fluid under pressure to the device.

The movable body 11 (as shown in FIG. 2) is biased by a leaf spring 17 to improve the reliability of the device in operation. The leaf spring 17 is installed in such a manner that one end thereof is received in a recess 18 of the tube 10 of the control member 9. The other end of the leaf spring 17 bears against a recess 19 of the movable body 11. The movable body 11 engages the casing 1 to axially fix the control member 9 and this is best accomplished by using a seat 20. The seat 20 is provided in the casing 1 and has its rear-end face 21 designed to engage a rear-end face 22 of the movable body 11. The seat 20 also has a front-end ramp 23 for facilitating the displacement of the movable body 11 when it moves into the socket 12 of the tube 10 of the control member 9 so as to enable the movement of the control member 9 relative to the casing 1 when the device is reversed. Referring to FIG. 3, a front-end stop 24 of the tube 10 of the control member 9 enables the limiting of the control member 9 in the position in which it controls the distribution of fluid under pressure for the rearward movement function of the device. The device is also provided with a compression spring 25. The compression spring 25 enables the displacement of the control member 9 to the front-end position for controlling the distribution of fluid under pressure for the forward movement function of the device. Referring to FIG. 2, the tube 10 of the control member 9 has a rear-end stop 26 for limiting the axial displacement of the control member 9. The device operates in the following manner in the forward movement function.

Fluid under pressure is fed, as shown in FIG. 1, through the flexible conduit 14 and tube 10 to the rear-end working chamber 6 and, via the port 7, to the front-end working chamber 5.

The control member 9 and the tube 10 are caused to move backwards (toward the tail part 3 of the casing 1) under the action of fluid under pressure in the rear-end working chamber 6 as shown in FIG. 3, to compress the compression spring 25.

At the same time, fluid under pressure fed from the tube 10 through the opening in the tube 10 to the eccentric surface 15 of the movable body 11 causes the movable body to move within the socket 12 of the tube 10 so as to be received in the seat 20 of the casing 1. The force of the leaf spring 17 is such as not to hamper the movement of the movable body 11 within the socket 12 of the tube 10. When the movable body 11 is in its new position, its rear-end face 22 bears against the rear-end face 21 of the seat 20 of the casing 1 to lock the tube 10 and the control member 9 with respect to the casing 1. This position of parts of the device corresponds to the forward movement function of the device.

The striker 4 reciprocates in the casing 1 under the action of fluid under pressure in the front-end chamber 5 and the rear-end chamber 6 to impart blows to the head part 2 of the casing 1 (FIG. 1). Under the action of such blows the device moves in the soil to leave a hole behind. Fluid under pressure is admitted to the front-end working chamber 5 through the port 7 and is exhausted therefrom through the port 7 and the port 8. To reverse the device (switch it over for the rearward movement function), the supply of fluid under pressure should be interrupted. Then the compression spring 25 (FIG. 2) causes the control member 9 and the tube 10 to move forward toward the head part 2 of the casing 1 of the device (FIG. 1). The movable body 11 is thus caused to move out of the socket 12 of the tube 10 by the leaf spring 17 and the front-end ramp 23 of the seat 20 and takes the position shown in FIG. 2. The rear-end stop 26 of the tube 10 engages the casing 1. Subsequently the flexible conduit 14 is to be pulled back with a force to overcome the force of the compression spring 25. Referring to FIG. 4, the control member 9 and the tube 10 are thus caused to move toward the tail part 3 of the casing 1 until the movable body 11 passes by the seat 20 of the casing 1 to take the position closer to the tail part 3 of the casing 1 (to the right from the seat as shown in the Figure). Now fluid under pressure is to be fed to the working chambers 5 and 6 of the device without removing the pulling force from the flexible conduit 14. The control member 9 and the tube 10 are caused to move toward the tail part 3 of the casing 1 under the action of fluid under pressure in the working chamber 6 until the front-end stop 24 of the tube 10 touches the casing 1. The movable body 11 remains within the socket 12 of the tube 10 since it is covered by the casing 1. The compression spring 25 is compressed. After the fluid under pressure has been fed, the flexible conduit should be released. The striker 4 reciprocates in the casing 1 under the action of fluid pressure in the front-end working chamber 5 and in the rear-end working chamber 6.

Owing to the fact that the control member 9 now takes a new position in which it is offset axially towards the tail part 3 of the casing 1, fluid under pressure is admitted through the ports 7 to the front-end working chamber 5 earlier and the exhaust from the front-end working chamber 5 through the ports 7 and 8 occurs later so that the striker 4 imparts blows to the tail part 3 of the casing 1. Under the action of such blows the casing 1 and the entire device move along the driven hole toward the launching point.

The device is automatically switched over back for the forward movement function after the interruption of fluid supply to the device. In such case the compression spring 25 as shown in FIG. 2 again causes the tube 10 and the control member 9 to move to the front-end position until the rear-end stop 26 of the tube 10 touches the casing 1. Now, after fluid under pressure is fed to the device as described above, the parts of the device will take the position shown in Figure 3, and the device performs in the forward movement function.

INDUSTRIAL APPLICATION

The reversible percussion device according to the invention features simplicity in manufacture and ensures a reliable locking of its control member in limit positions with respect to the casing; it is also very convenient and reliable in operation compared to known devices of similar type.

We claim:

1. A reversible percussive device comprising:

(a) a casing;

(b) a striker mounted in said casing for reciprocation under the action of a pressurized fluid medium; and (c) a system for distributing the pressurized fluid in said casing to cause the striker to reciprocate in said casing so as to impart blows to a front-end part of the casing when the device is set for a forward movement operation and to impart blows to a rear-end part of the casing when the device is set for a rearward movement operation, the system having:

(i) a control member movably coupled with the striker for controlling the distribution of said pressurized fluid medium when in a first position and for controlling the distribution of said pressurized fluid medium for the rearward movement operation when in a second operation; and (ii) locking means for axially locking said control member with respect to said casing, and including:

(A) a port in fluid communication with a source of said pressurized fluid medium;

(B) a seat formed in an external surface of said control member and in fluid communication with said port, said seat being in the form of a substantially crescent-shaped groove arranged eccentrically with respect to the longitudinal axis of the device;

(C) a substantially crescent-shaped movable body positioned in said seat; and (D) receiving means in said casing for receiving said movable body to lock the control member with respect to the casing;

(E) wherein said pressurized fluid passes through said port and biases said movable member into said receiving means to axially lock the control member with respect to said casing in said first position and permits axial movement of said control member with respect to said casing in said second position.

2. A device according to claim 1; wherein said locking means further includes spring means for biasing said movable body in said seat.

3. A device according to claim 2; wherein said control member further includes a recess adjacent said seat, and said spring means further includes a leaf spring having one end received in said recess and an opposite end which bears against said movable body.

4. A device according to claim 1; further including spring means for biasing said control member with respect to said casing.

* * * * *

UNITED STATES PATENT AND TRADEMARK OFFICE

CERTIFICATE OF CORRECTION

PATENT NO. : 4,819,741

DATED : April 11, 1989

INVENTOR(S) : Terskov et al.

It is certified that error appears in the above-identified patent and that said Letters Patent is hereby corrected as shown below:

In the Title: Please change "REVERSIELE" to --REVERSIBLE--

Signed and Sealed this

Third Day of October, 1989

*Attest:*

DONALD J. QUIGG

*Attesting Officer*

*Commissioner of Patents and Trademarks*